United States Patent [19]

Morell

[11] Patent Number: 4,971,330

[45] Date of Patent: Nov. 20, 1990

[54] GOLF BALL

[75] Inventor: Joseph Morell, Annecy, France

[73] Assignee: Salomon S.A., Annecy, France

[21] Appl. No.: 441,819

[22] Filed: Nov. 27, 1989

[30] Foreign Application Priority Data

Nov. 29, 1988 [FR] France ..... 88 15572

[51] Int. Cl.[5] ..... A63B 37/14

[52] U.S. Cl. ..... 273/232

[58] Field of Search ..... 273/232; 40/327

[56] References Cited

U.S. PATENT DOCUMENTS 4,762,326 8/1988 Gobush ..... 273/232

4,772,026 9/1988 Gobush ..... 273/232

4,844,472 7/1989 Ihara ..... 273/232

*Primary Examiner*—George J. Marlo

[57] ABSTRACT

The present invention relates to a golf ball.

In order to improve the indifferent character of the orientation of the ball with respect to the strike, the peripheral surface (2) of it has dimples (115,116) essentially distributed inside 48 identical elemental surfaces (113), in the form of spherical right-angle triangles, and 24 identical elemental surfaces (114) in the form of spherical quadrilaterals delimited by 10 equatorial circles (56 to 61, 108 to 111) of the sphere defining the general shape of the peripheral surface (2) of the ball (3).

9 Claims, 1 Drawing Sheet

GOLF BALL

The present invention relates to a golf ball of the type having a peripheral surface having the general shape of a sphere and a plurality of dimples arranged in the said peripheral surface and distributed on the latter in accordance with at least one repetitive motif, at least essentially inside elemental spherical surfaces defined by sub-division of the said peripheral surface along arcs of circles centered on the centre of the sphere and mutually connecting points of the peripheral surface corresponding to points determined by a cube inscribed in the sphere.

A golf ball of this type is described in French Pat. No. 735,555, and more precisely with reference to FIGS. 14 to 18 of this document; with reference to these figures, this latter recommends the sub-division of each of the six faces of the cube into four principal triangles of which each is divided into 9, or 16, or 60 triangles determining the positions of the dimples.

This known mode of sub-division of the peripheral surface of a golf ball has an inconvenience in that the behaviour of the latter in its trajectory is narrowly tied to the orientation of the ball with respect to the strike; in effect, even if the dimples are arranged with the same motif in the 24 elemental surfaces, in spherical triangular form, resulting from the sub-division of each of the faces of the cube into four principal triangles, the probability of successive strikes hitting the peripheral surface of the ball in its zones having different geometries is significant; in other words, unless great care is taken in the positioning of the ball before the strike, in a manner difficult to practically envisage, a ball having the distribution of dimples recommended with reference to FIGS. 14 to 18 of French Pat. No. 735,555 will not lend itself to suitable reproduceability of strikes, and consequently of trajectories.

The object of the present invention is to remedy this inconvenience by proposing, also from a cube inscribed inside the sphere, a finer sub-division of the surface of this, in order to increase the homogeneity of distribution of the dimples and consequently to obtain a characteristic as indifferent as possible to the orientation of the ball with respect to the strike.

To this end, the ball of the invention, of the type indicated in the preamble, is characterised in that the sub-division is carried out along:

6 equatorial circles of which each is centred on an axis passing through the respective mid-points of two diametrically opposed edges of the cube and passes through 4 apices of the latter, 4 equatorial circles of which each is centred on an axis passing through two diametrically opposed apices of the cube and passes through the radial projections, onto the sphere, of respective mid-points of 6 paired perpendicular edges of the cube, in a manner to define 48 identical elemental surfaces in spherical right-angle triangle form and 24 identical elemental surfaces in spherical quadrilateral form having two opposite right angles and two opposite angles different from each other between two respective sides of equal length.

With respect to the disposition described in the mentioned French patent, the number of elemental surfaces is greatly increased, which greatly increases the homogeneity of distribution of dimples on the surface of the ball, and consequently the probability of an identical relative orientation of a dimple and of the strike for successive strikes; preferably, the dimples are distributed according to an identical motif in each of the identical elemental surfaces, which again increases this probability, but the scope of the present invention will not be departed from by providing other arrangements in this regard, and particularly in providing more disposition motifs for the dimples in the elemental surfaces, each motif being attributed to some elemental surfaces regularly distributed on the sphere.

Particularly for reasons of ease of manufacture, it is preferred that at least one determined equatorial circle, amongst the said equatorial circles, cuts none of the dimples; this determined circle can correspond to a joint plane when the ball is manufactured by assembly of two identical halves or when at least one surface layer of it, including the dimples, is made by moulding in a single piece in a mould itself formed of two assembled identical halves; taking account of the fine sub-division of the peripheral surface of the ball and of the homogeneity of distribution of the dimples which results, one can then allow one of the halves of the ball or of the mould, respectively, possibly to be angularly displaced with respect to the other half about the axis of the said determined equatorial circle; in this case, the said determined equatorial circle sub-divides each of the other said equatorial circles into two circular arcs, of which each corresponds to one of two hemispheres defined by the said determined equatorial circle, and the circular arcs of one of the hemispheres are angularly displaced, with respect to the respectively corresponding circular arcs of the other of the hemispheres, by the same amount about the axis of the said determined equatorial circle; the fact of allowing such a disposition considerably eases the manufacture of the ball by assembly of two halves or by moulding in a mould formed of two assembled halves, because it is not necessary to perform a precise adjustment of the relative angular position of the two halves of the ball or of the mould, respectively, in manufacture of the ball.

Other characteristics and advantages of a ball according to the present invention will appear from the description below, relating to a non-limitative embodiment, as well as from the accompanying drawing which forms an integral part of this description.

Figure 1:
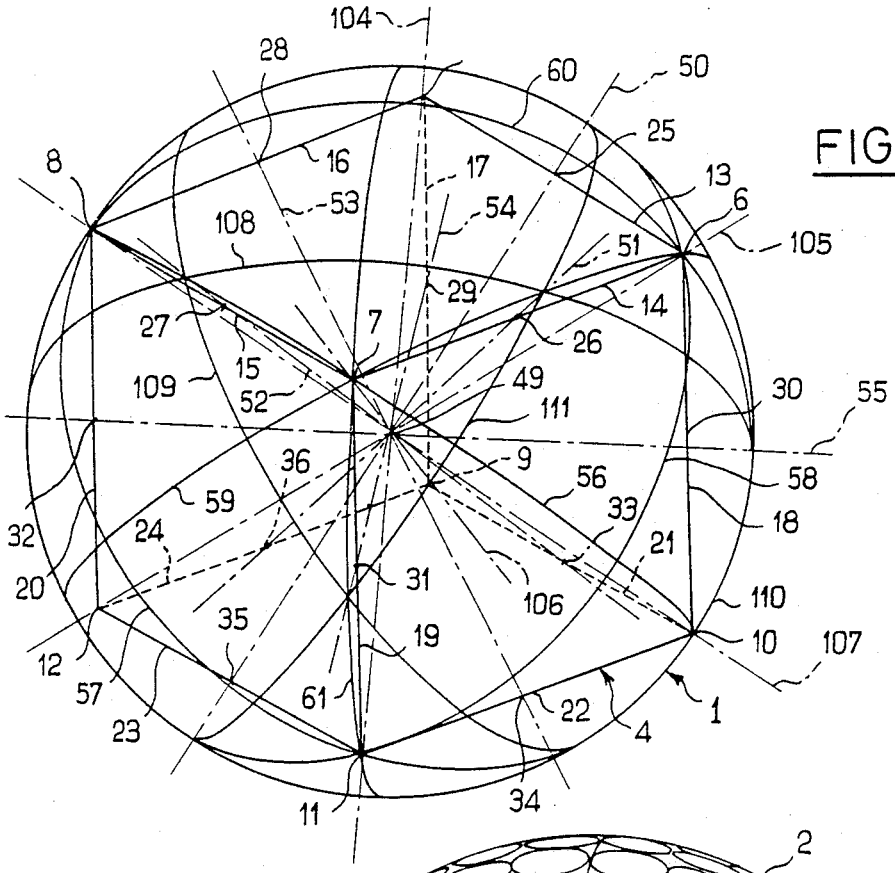
FIG. 1 illustrates the construction, in accordance to with the present invention, of 10 equatorial circles on a sphere from a cube inscribed in this latter.
Figure 2:
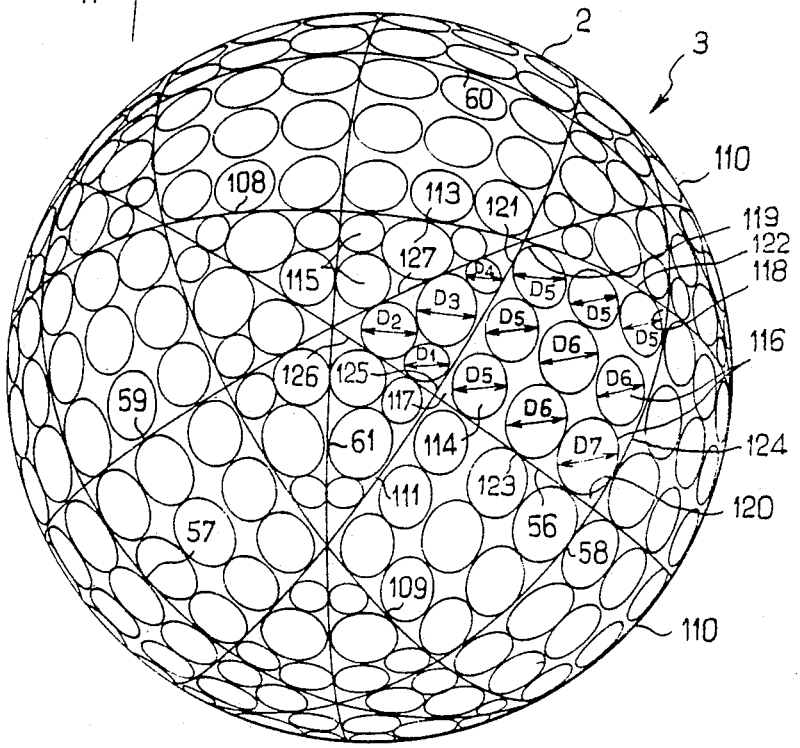
FIG. 2 shows a golf ball of which the dimples are distributed in the identical elemental surfaces obtained by this sub-division by means of 10 equatorial circles.

Referring in the first place to FIG. 1 where there is designated by 1 a sphere producing the general shape of the peripheral surface 2 of a golf ball 3 illustrated in FIG. 2, and by 4 a cube inscribed in this sphere 1 on which there are 8 apices 5 to 12 connected in pairs by 12 edges 13 to 24 of which each has a mid-point 25 to 36 and which, in fours, define six square faces not referenced; the cube 4 itself and the sphere 1 have a common centre 49 which will serve as a reference when reference is made below to the concept of diametrically opposed positions or of radial projection.

For geometrical reasons, the edges 13 to 24 of the cube 4 are distributed in 6 groups of two mutually parallel, diametrically opposed edges, that is to say edges 13 and 23, 14 and 24, 15 and 21, 16 and 22, 17 and 19, 18 and 20 of which the respective mid-points also occupy diametrically opposed positions; in accordance with the present invention, by means of the respective mid-points of two edges, also diametrically opposed, axes are determined, that is to say the axis 50 passing through the mid-points 25 and 35, the axis 51 passing through the mid-points 26 and 36, the axis 52 passing through the mid-points 27 and 33, the axis 53 passing through the mid-points 28 and 34, the axis 54 passing through the mid-points 29 and 31, and the axis 55 passing through the mid-points 30 and 32; around 6 of the axes thus determined, in a plane (not referenced) perpendicularly cutting this axis at the centre 49 of the cube 4 and of the sphere 1, is traced on this sphere 1 an equatorial circle passing through 4 apices of the cube, that is to say the circle 56 having the axis 50, passing through the apices 7,8,9,10, the circle 57 having the axis 51, passing through the apices 5,10,11,8, the circle 58 having the axis 52, passing through the apices 5,6,11,12, the circle 59 having the axis 53, passing through the apices 6,7,12,9, the circle 60 having the axis 54, passing through the apices 6,10,12,8 and the circle 61 having the axis 55, passing through the apices 5,9,11,7; these six circles 56 to 61 are also represented on the peripheral surface 2 of the ball 3 in FIG. 2, but it will be noted that it is not necessary for these circles to be materially reproduced on this surface 2.

It will be noted that, for geometrical reasons, each of the 6 equatorial circles 56 to 61 defines by its plane (not referenced) a plane of symmetry for the 5 other equatorial circles.

Further, in accordance with the present invention, there are defined 4 supplementary axes 104,105,106,107, of which each passes through 2 diametrically opposed apices of the cube 4, that is to say respectively the apices 5 and 11, 6 and 12, 7 and 9, 8 and 10.

About each of the these axes 104 to 107 is described, on the sphere 1, a respective equatorial circle 108,109, 110,111; it will be noted that each of these equatorial circles 108,109,110,111 passes through the radial projections, onto the sphere, of the respective mid-points of 6 paired perpendicular edges of the cube; in other words, the circle 108 cuts at 2 points each of the 3 axes 51,52 and 55, the circle 109 cuts at 2 points each of the 3 axes 52,53 and 54, the circle 110 cuts at 2 points each of the 3 axes 50,53 and 55 and the circle 111 cuts at 2 points each of the 3 axes 50,51 and 54.

As also appears in FIG. 2, on the peripheral surface 2 of the ball 3, the 4 supplementary equatorial circles 108 to 111 thus defined are not necessarily materially reproduced on this surface 2, as with the 6 previously mentioned equatorial circles.

The 4 equatorial circles 108 to 111 define with the 6 equatorial circles 56 to 61 previously described 48 identical elemental surfaces 113 of spherical right-angle triangle form, regularly distributed in sub-groups of 6 around the sphere 1, and 24 identical elemental surfaces 14 of spherical quadrilateral form regularly distributed in sub-groups of 4 about the sphere 1; each elemental surface 114 has 2 opposite right angles 117 and 118 and 2 opposite angles 119 and 120 which are between themselves different from each other and of which each is situated between 2 sides of equal length referenced 121 and 122, 123 and 124 respectively; the 2 sides 121 and 122 are shorter than the 2 sides 123 and 124 whilst the angle 119, in practice obtuse, is greater than the angle 120, in practice a right angle; 2 elemental surfaces 114 are mutually adjacent at the edges 123 and 124 whilst each elemental surface 114 is adjacent to an elemental surface 113 by each of the sides 121 and 122, constituting by this elemental surface 113 a large side of the right angle 125 of which the small side is designated by 126 whilst the hypothenuse has been designated by 127, each elemental surface 113 being adjacent to 2 other elemental surfaces 113 at this small side and at this hypothenuse.

As appears more particularly from FIG. 2, dimples such as 115,116 are distributed in accordance with respectively determined motifs inside the elemental surfaces 113 and inside the elemental surfaces 114, without overlapping of any of the equatorial circles in the illustrated example although such overlapping is admissable to a certain extent; preferably, however, at least one of the equatorial circles cuts none of the dimples 115,116 to correspond with a joint plane between 2 halves of the ball if it is made in 2 halves, or between 2 halves of a mould intended for the production of the ball, or at least of a surface layer of the latter having the dimples, in a single piece by moulding; in a non-illustrated manner, this determined equatorial circle can sub-divide each of the other equatorial circles into 2 circular arcs mutually angularly displaced, by the same amount, about the axis of this equatorial circle, which will certainly cause the disappearance of the mentioned symmetries but is not really harmful to the homogeneity of distribution of the dimples 115,116 on the peripheral surface of the ball; preferably, and although there is no departure from the scope of the present invention in adopting a different arrangement, the motif for distribution of the dimples 115 is identical from 1 elemental surface to another as is the motif for distribution of the dimples 116 in the elemental surfaces 114; by way of non-limitative example there are shown 4 dimples in the form of part-spherical depressions 115 in each elemental surface 113 and 9 dimples in the form of part spherical depressions 116 in each elemental surface 114, but this number, the distribution and the shape of the dimples for each elemental surface can be different without departing from the scope the present invention.

More precisely, in the non-limitative illustrated example, the dimples 115 define , by their intersection with the spherical, peripheral surface 2 of the ball with a diameter of the order of 42.67 mm, circles distributed in the following manner in each elemental surface 113:

1 circle of diameter $D_1$ of the order of 1.32 mm, positioned in the right angle 125 and approximately tangential to the 2 sides 121 (or 122) and 126 of the right angle 125, 1 circle of diameter $D_2$ of the order of 1.65 mm, approximately tangential to the circle of diameter $D_1$ to the small side 126 of the right angle 125 and to the hypothenuse 127, 1 circle of diameter $D_3$ of the order of 2.00 mm, approximately tangential to the circles of diameters $D_1$ and $D_2$, to the large side 121 (or 122) of the right angle 125 and to the hypothenuse 127, 1 circle of diameter $D_4$ of the order of 1.10 mm, approximately tangential to the circle of diameter $D_3$, to the large side 121 or (122) of the right angle 125 and to the hypothenuse 127.

Further, in the non-limitative illustrated example, the dimples 116 define, by their intersection with the spherical peripheral surface 2 of the ball with a diameter of the order of 42.67 mm, circles distributed in the following manner in each elemental surface 114:

5 circles of diameter $D_5$ of the order of 1.80 mm, of which a first is positioned in the said comparatively large angle 119 and approximately tangential to the said comparatively short sides 121 and 122, of which a second and a third are approximately tangential to the said first of the five circles and, respectively, to one and the other of the comparatively short sides 121 and 122, and of which a fourth and a fifth are positioned respectively in one and the other of the said right angles 117 and 118 and approximately tangential respectively to the said second of the 5 circles, to the said corresponding comparatively short side 121, and to the one 123 of the said comparatively long sides and to the said third of the 5 circles, to the said corresponding comparatively short side 122, and to the other 24 of the said comparatively long sides, 3 circles of diameter $D_6$ of the order of 2.05 mm, of which a first is approximately tangential to the said second and third of the 5 circles and of which a second and a third are approximately tangential to the said first of the 3 circles and, respectively, to the said fourth of the 5 circles and to the said corresponding comparatively long side 123, and to the said fifth of the 5 circles and to the said corresponding comparatively long side 124, 1 circle of diameter $D_7$ of the order of 2.25 mm, positioned in the said comparatively small angle 120 and approximately tangential to the said second and third of the 3 circles and to the one and the other of the said comparatively long sides 124 and 125.

With reference to the spherical, peripheral surface 2 of the ball, each of the dimples such as 115 and 116 has a depth increasing with the diameter of its intersection with the peripheral surface, that is to say a depth of the order of 0.1 mm, for the dimples such as 115 and 116 corresponding to the mentioned circles of smallest diameter, to 0.5 mm for the dimples such as 115 and 116 corresponding to the mentioned circles of greatest diameter; as for the values of the diameters $D_1$, $D_2$, $D_3$, $D_4$, $D_5$, $D_6$, $D_7$, these values of depth are given by way of non-limitative example only.

In a general manner, the present invention is susceptible of numerous variants without departing from its scope.

I claim:

1. A golf ball comprising a peripheral surface having a general shape of a sphere and a plurality of dimples arranged in the said peripheral surface and distributed on the latter in accordance with at least one repetitive motif, defined by sub-division of said peripheral surface along arcs of equatorial circles centred on a centre of said sphere and mutually connecting points of said peripheral surface corresponding to determined points of a cube inscribed in said sphere, said circular arcs defining elemental spherical surfaces and said dimples being essentially inside said elemental surfaces, wherein said sub-division is carried out along:

6 said equatorial circles of which each is centred on an axis passing through respective mid-points of two diametrically opposed edges of said cube and passes through four apices of the latter, 4 said equatorial circles of which each is centred on an axis passing through two diametrically opposed apices of said cube and passes via radial projections onto said surface of respective mid-points of 6 paired perpendicular edges of said cube, in a manner to define 48 identical elemental surfaces in spherical right-angle triangle form and 24 identical elemental surfaces in spherical quadrilateral form having two opposite right angles and two opposite angles different from each other, between two respective sides of equal length.

2. A golf ball according to claim 1, wherein at least a determined one of said equatorial circles, cuts none of said dimples.

3. A golf ball according to claim 2, wherein said determined equatorial circles sub-divides each of the other said equatorial circles into two circular arcs, of which each corresponds to one of two hemispheres defined by said determined equatorial circle, and said circular arcs of one of said hemispheres are angularly displaced, with respect to respectively corresponding ones of said circular arcs of the other of said hemispheres, by the same amount about an axis of said determined equatorial circle.

4. A golf ball according to claim 2 wherein none of said equatorial circles cuts one of said dimples.

5. A golf ball according to claim 1, wherein said dimples are distributed in accordance with an identical motif in said identical elemental surfaces.

6. A golf ball according to claim 5, wherein said sphere has a diameter of the order of 42.67 mm, and said dimples define by their intersection with said peripheral surface circles distributed in the following manner in each said elemental surface of spherical right-angle triangle form, of which the right angle is situated between two sides of different length:

one circle of diameter $D_1$ of the order of 1.32 mm, positioned in said right angle and approximately tangential to said two sides of said right angle, one circle of diameter $D_2$ of the order of 1.65 mm, approximately tangential to the circle of diameter $D_1$ and to a smaller of said sides of said right angle and to a hypothenuse opposite said right angle, one circle of diameter $D_3$ of the order of 2.00 mm, approximately tangential to said circles of diameters $D_1$ and $D_2$, to a larger of said sides of said right angle and to said hypothenuse, one circle of diameter $D_4$ of the order of 1.10 mm, approximately tangential to said circles of diameter $D_3$, to said larger side of said right angle and to said hypothenuse.

7. A golf ball according to claim 6, wherein each said dimple has a depth of the order of 0.1 mm to 0.5 mm increasing with correspondingly increasing diameter of its circle.

8. A golf ball according to claim 5, wherein said sphere has a diameter of the order of 42.67 mm, and said dimples define by their intersection with said peripheral surface circles distributed in the following manner in each said elemental surface of spherical quadri-lateral form, of which said two sides are shorter than the other two said sides:

5 circles of diameter $D_5$ of the order of 1.80 mm, of which a first is positioned in a comparatively large (119) of said different opposite angles, and approximately tangential to said comparatively short sides, of which a second and a third are approximately tangential to said first of said 5 circles and, respectively, to one and the other of said comparatively short sides, and of which a fourth and a fifth are positioned respectively in one and the other of said right angles and approximately tangential respectively to said second of said 5 circles, to said corresponding comparatively short side, and to the other of said comparatively long sides and to said third of said 5 circles, to said corresponding comparatively short side, and to the other of said comparatively long sides, 3 circles of diameter $D_6$ of the order of 2.05 mm, of which a first is approximately tangential to said second and third of said 5 circles and of which a first and a second are comparatively tangential to said first of said 3 circles and, respectively, to said fourth of said 5 circles and to said corresponding comparatively long side, and to said fifth of said 5 circles and to said corresponding comparatively long side, 1 circle of diameter $D_7$ of the order of 2.25 mm, positioned in the comparatively small of said opposite different angles and approximately tangential to said second and third of said 3 circles and to one and the other of said comparatively long sides.

9. A golf ball according to claim 1, wherein each said dimple is shaped as a spherical depression.

* * * * *